United States Patent [19]

Eggenberger

[11] Patent Number: 4,966,364

[45] Date of Patent: Oct. 30, 1990

[54] SNOWBOARD SIMULATOR

[76] Inventor: Jean-Albert Eggenberger, P.O. Box 604, Fort Langley, British Columbia, Canada, VOX 1JO

[21] Appl. No.: 319,948

[22] Filed: Mar. 7, 1989

[51] Int. Cl.[5] ..... A63B 7/08

[52] U.S. Cl. ..... 272/111; 272/97

[58] Field of Search ..... 272/30, 54–56, 272/146, 111, 96, 145, 97; D21/193, 227, 235, 251; 36/120, 125

[56] References Cited

U.S. PATENT DOCUMENTS

| | | | |
|---|---|---|---|
| 2,714,007 | 7/1955 | Jordan | 272/146 |
| 3,024,021 | 3/1962 | Coplin et al. | 272/146 |
| 3,207,510 | 9/1965 | Gibson | 272/97 |
| 3,641,601 | 2/1972 | Sieg | 272/146 X |
| 3,863,915 | 2/1975 | Pifer | 272/54 X |
| 4,252,312 | 2/1981 | Dehan | 272/97 |
| 4,403,785 | 9/1983 | Hottel | 280/14.2 |
| 4,741,550 | 5/1988 | Dennis | 280/14.2 X |
| 4,787,630 | 11/1988 | Watson et al. | 272/146 |

*Primary Examiner*—Richard J. Apley
*Assistant Examiner*—D. F. Crosby
*Attorney, Agent, or Firm*—Christie, Parker & Hale

[57] ABSTRACT

A snowboard simulator having a snowboard-like frame that is resiliently mounted intermediate its length on a base. Its resilient cushion member allows the stationary device to simulate the tipping, sloping and standing angles requiring acute balance when participating in snowboarding. A leading foot mounting unit and a trailing foot mounting unit are detachably mounted on the top surface of the snowboard-like frame. There is also structure between the bottom surface of the snowboard-like frame and the top surface of the cushion member that allows the snowboard-like frame to rotate through a range of 360 degrees.

7 Claims, 1 Drawing Sheet

SNOWBOARD SIMULATOR

FIELD OF THE INVENTION

The invention relates to a simulator and more specifically to one for practicing the skills and balance required for riding a snowboard.

Winter sports are very popular today. Many of these sports require balance and agility. Snowboarding is a sport which combines the balance and agility of surfing with the pleasure and surroundings of skiing and it is done world wide.

To the novice, snowboarding can be dangerous. Unless one is skilled in maintaining their balance on board in motion, the likelihood of losing one's balance and having an accident is increased. An accident on a mountain slope or hillside can break bones or even cause paralysis or death. In short, the sport can be dangerous to the neophyte just learning how to balance on a board.

Applicant's device removes the hazards of the hillsides and mountain slopes while learning the sport of snowboarding. by simply setting the device in a clear open room on a level surface, the user can simulate the motions of a downhill ride on a snowboard. By emulating the motions likely to be encountered, a beginner will learn the skills necessary to master the sport. By rotating the footholds the rider can position himself in an opposing direction.

There is, therefore, a need for a device which will enable the inexperienced person to replicate conditions encountered on a snowboard sliding on a downhill slope. The user benefits from the experience without the exposure to injury.

SUMMARY OF THE INVENTION

Applicant's device will help the user learn the balance skills necessary to engage in the sport of snowboarding. It is a stationary device which simulates the tipping, sloping and standing angles requiring acute balance when participating in snowboarding. It was designed for the sport of snowboarding, but it has many applications. Balancing skills may abe applied to surfing, skateboarding, as well as aerobic exercise and it is an excellent means of weight loss and weight control. Medical science is constantly supportive of physical exercise as the benefits accrue to both young and old, and males and females.

The snowboard simulator has an elongated snowboard-like frame having an upwardly tipped front end. The snowboard-like frame is mounted on a semi-soft cushion member that itself is mounted on a support base. An annular race having an open top face and being filled with ball bearings is mounted on the top of the cushion member with the ball bearings being in contact with the bottom surface of the snowboard-like frame. This gives the simulator the ability to rotate 360 degrees while at the same time the semi-soft cushion member enables the snowboard-like frame to tilt and slant at any angle commone to the sport of snowboarding.

Located on the underside of the board at its forward end and rearward end are rubber tips. These rubber tips cushion the board and prevent abrupt contract with the floor in the event the user slopes the board too far toward the front or rear.

Detachably mounted on the upper surface of the snowboard-like frame are foot mounting units. The leading foot mounting unit is mounted centrally over the ring of ball bearings. Should one's weight be placed solely on the leading foot, the rocking motion would be arrested. The trailing or rear foot mounting unit is mounted adjacent the rear end of the snowboard-like frame and it is used to direct control of tipping action. The user or rider can swivel, tip and cant the board to simulate conditions encountered on a downhill snowboard ride.

Both foot mounting units are equipped with a spring-loaded stud bolt passing from the sole of the shoe through the snowboard-like frame and it is secured by a retaining nut on the underside. The spring holds the shoe securely against the top surface of the board. To further ensure the stable position of the foot mounting units, each of the foot mounting units are provided with a front and rear spike which mate to retaining cups recessed in the top surface of the board. Once aligned, the spike and cup mechanism will hold the foot mounting unit in place. The user can make the option of directional orientation when riding on the snowboard. The foot holds provide support to the ankles and better enable the rider to maintain control while learning the skills of snowboarding.

To practice snowboarding with the invention, the user simply sets the device in an open area on a level floor. Slipping each foot into the foot mounting units, the user then simulates rocking, turning and sloping action. the user's balance is honed and proper positioning is learned in a safe environment.

DESCRIPTION OF THE PREFERRED EMBODIMENTS

Figure 1:
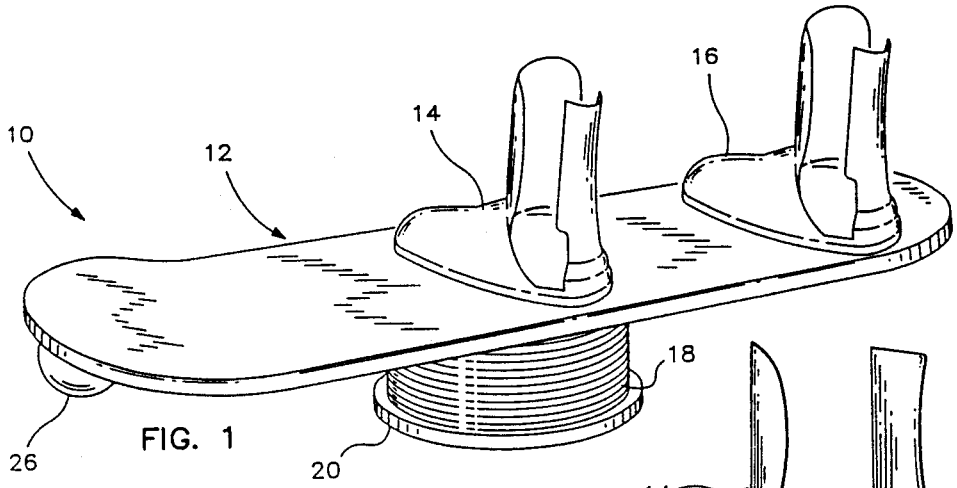
FIG. 1 is a front perspective view illustrating applicant's novel snowboard simulator.
Figure 2:
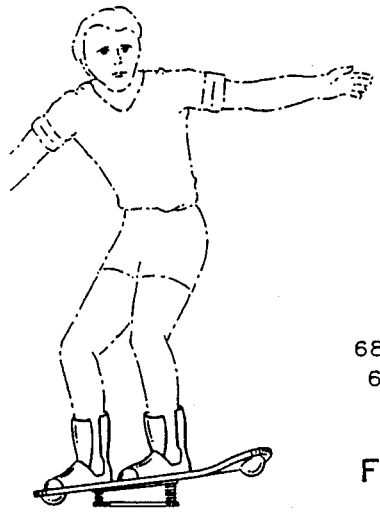
FIG. 2 shows a male using applicant's novel snowboard simulator.
Figure 3:
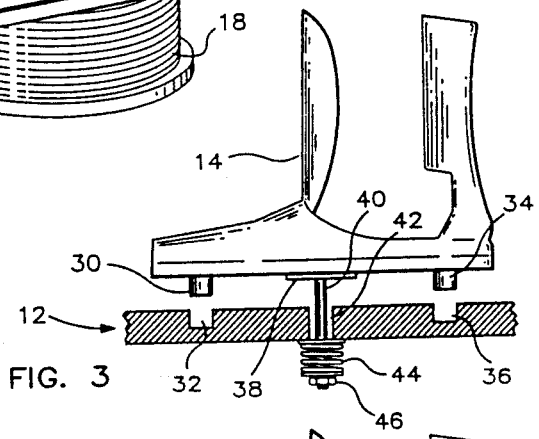
FIG. 3 is a partial cross sectional view illustrating the structure for securing the foot mounting units to the top of the board.

Applicant's novel snowboard simulator will be described by referring to FIGS. 1 to 5 of the drawings. The snowboard simulator is generally designated numeral 10.

The basic components of snowboard simulator 10 are frame 12, leading foot mounting unit 14, trailing foot mounting unit 16, cushion member 18 and support base 20.

Frame 12 has a main body portion 22 and an upwardly sloped front tipped portion 24. A hemispherically shaped rubber cushion tip 26 is mounted adjacent the front end and a rubber tipped cushion 28 is mounted adjacent the rear end of the frame. Leading foot mounting unit 12, which is centrally positioned over cushion member 18, has its securing structure best illustrated in FIG. 3. Toe spike 30 is detachably received in retaining cup 32 and heel spike 34 is detachably retained in retaining cup 36. A plate 38 is secured to the bottom surface of leading foot mounting unit 14 and it has a stud or post 40 secured thereto. Stud 40 passes through bore 42 and has a coil spring 44 surrounding it that is captured by the retaining nut 46.

Figure 4:
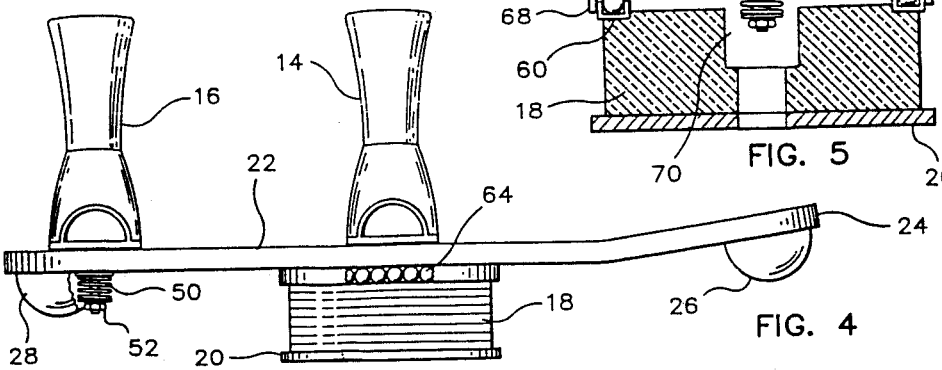
FIG. 4 is a side elevation view of the novel snowboard simulator with portions broken away.

Trailing foot mounting unit 16 also has a stud secured to its bottom surface that passes through a bore adjacent the rear of frame 12. A coil spring 50 and retaining nut 52 are illustrated in FIG. 4.

Figure 5A:
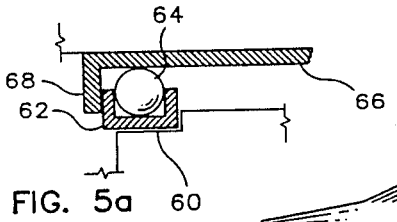
FIG. 5*a* is a partial view of the circular plate and annular race of FIG. 5.
Figure 5:
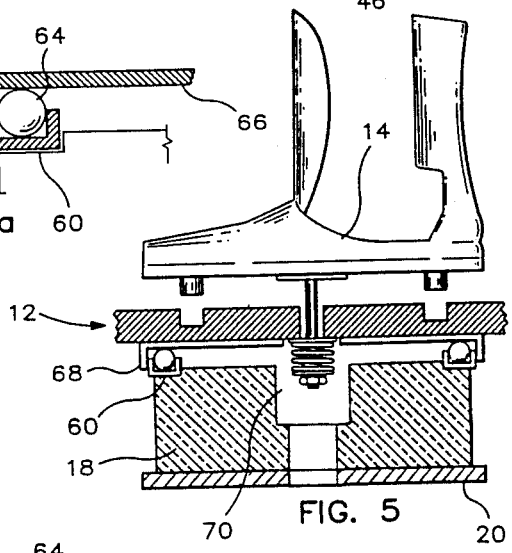
FIG. 5 is a cross sectional elevation view of the cushioning member and its interrelationship with the snowboard-like frame.

In FIG. 5, the structure which allows the frame 10 to rotate throughout a range of 360 degrees with respect to cushion member 18 is illustrated. An annular shoulder 60 is formed adjacent the tope end of cushion member 18. An annular race or channel 62 having a top end is mounted on shoulder 60 and a plurality of ball bearings 64 are mounted therein. A circular plate 66 having a downwardly extending outer flange 68 is secured to the under side of frame 10. The top of ball bearings 64 are in rolling contact with the bottom surface of circular plate 66. A cylindrical recess 70 is formed in the top surface of cushion member 18 for receiving the lower end of stud 40.

The embodiments of the invention in which an exclusive property or privilege is claimed are defined as follows:

1. A snowboard simulator comprising an elongated board having a longitudinal axis, a front end, a rear end, a top surface and a bottom surface;

a resilient cushion disposed beneath the board proximate the middle of the board, the cushion having an upper surface;

an anuular channel on the upper surface of the cushion;

bearings located in the annular channel;

a bearing receiving frame mounted on the bottom surface of the elongated board to surround the annular channel and ride on the bearings to allow 360° rotation of the frame relative to the cushion;

a leading foot mounting unit and a trailing foot mounting unit on the top of the board, each mounting unit having a toe and heel;

pivotal means for removably mounting the foot mounting units to the board; and means to locate the foot mounting units on the board at a first position with the toe of each foot mounting unit on one side of the board longitudinal axis or a second position with the toe of each foot mounting unit on the second side of the longitudinal axis of the board.

2. A snowboard-like simulator as recited in claim 1 further comprising cushioning means mounted on the bottom surface of said elongated board at its front end and at its rear end.

3. A snowboard-like simulator as recited in claim 1 wherein said elongated board has a main body portion having a planar top and bottom surface, and a front tip porttion that is curved upwardly from said body portion.

4. A simulator as claimed in claim 1 in which the pivotal means comprises a post attached to the foot mounting unit;

an opening in the board to receive each post; and fastening means attached to each post on the bottom surface of the board.

5. A simulator as claimed in claim 4 having a spring suroounding the post and between the bottom surface of the board and the fastening means, the spring urging the post, and thus the foot mounting unit, upwardly.

6. A simulator as claimed in claim 1 in which the means to locate the foot mounting units on the board comprises a projection and a recess able to receive the projection.

7. A simulator as claimed in claim 6 in which there is a pair of projections on each foot mounting unit and a corresponding pair of recesses on the board, beneath each foot mounting unit.

* * * * *

UNITED STATES PATENT AND TRADEMARK OFFICE

CERTIFICATE OF CORRECTION

PATENT NO. : 4,966,364

DATED : October 30, 1990

INVENTOR(S) : Jean-Albert Eggenberger

It is certified that error appears in the above-identified patent and that said Letters Patent is hereby corrected as shown below:

Column 1, line 59, after "angle" change "commone" to -- common --.

Column 2, line 28, after "action." change "the" to -- The --.

Column 3, line 11, after "the" and before "end" change "tope" to -- top --.

Column 3, line 32, after "an" and before "channel" change "anuular" to -- annular --.

Column 4, line 19, change "porttion" to -- portion --.
Column 4, line 28, change "suroounding" to -- surrounding --.

Signed and Sealed this

Twelfth Day of May, 1992

*Attest:*

DOUGLAS B. COMER

*Attesting Officer*

*Acting Commissioner of Patents and Trademarks*